US007154038B2

(12) United States Patent
Studer

(10) Patent No.: US 7,154,038 B2
(45) Date of Patent: Dec. 26, 2006

(54) STRING-SHAPED PRODUCT WITH CONNECTING AND/OR FIXING MEANS

(75) Inventor: Christoph Studer, Gretzenbach (CH)

(73) Assignee: Studer Draht - und Kabelwerk AG, Däniken (CH)

( * ) Notice: Subject to any disclaimer, the term of this patent is extended or adjusted under 35 U.S.C. 154(b) by 0 days.

(21) Appl. No.: 10/513,912

(22) PCT Filed: May 15, 2003

(86) PCT No.: PCT/CH03/00315

§ 371 (c)(1),
(2), (4) Date: Nov. 10, 2004

(87) PCT Pub. No.: WO03/098643

PCT Pub. Date: Nov. 27, 2003

(65) Prior Publication Data

US 2005/0167144 A1 Aug. 4, 2005

(30) Foreign Application Priority Data

May 15, 2002 (CH) ..... 0814/02

(51) Int. Cl.
*H01B 17/16* (2006.01)

(52) U.S. Cl. ..... 174/36; 174/74 R; 174/77 R

(58) Field of Classification Search ..... 174/110 R, 174/110 FC, 117 F, 117 FF, 120 R, 120 C, 174/121 R, 74 R, 77 R; 439/279–282
See application file for complete search history.

(56) References Cited

U.S. PATENT DOCUMENTS 3,406,045 A * 10/1968 Sattler ..... 428/383
3,928,210 A * 12/1975 Peterson ..... 524/563
4,008,368 A * 2/1977 Leuchs ..... 174/120 R
4,101,699 A * 7/1978 Stine et al. ..... 428/36.91
4,877,467 A 10/1989 Marsden et al.
5,151,561 A * 9/1992 Emery et al. ..... 174/120 R
5,416,269 A 5/1995 Kemp et al.
6,114,036 A * 9/2000 Rinehart et al. ..... 428/383
2003/0166812 A1* 9/2003 Taniguchi et al. ..... 526/274
2003/0207106 A1* 11/2003 Nakamura et al. .... 428/355 EN
2005/0089290 A1* 4/2005 Chase et al. ..... 385/128
2005/0187320 A1* 8/2005 Malz et al. ..... 524/210

FOREIGN PATENT DOCUMENTS

CA WO 02/076726 A1 * 10/2002
DE 24 16 939 10/1975
EP 0 539 148 A2 * 10/1992
EP 0 539 148 4/1993

* cited by examiner

*Primary Examiner*—William H. Mayo, III
(74) *Attorney, Agent, or Firm*—Wenderoth, Lind & Ponack, L.L.P.

(57) ABSTRACT

An electric cable is configured as a sensor cable, wherein the lead insulation of the cable has a polymer layer. The sensor cable can be produced by, after extruding the raw cable, cutting the cable into individual cable sections in a non-crosslinked state. The sections are then connected to a sensor in an electrically conductive manner. The housing of the sensor consists of a plastic material that is compatible with the lead insulation and that is radiation crosslinkable. The polymers of the lead insulation and the polymers of the sensor housing are crosslinkable with themselves and with one another. A compatibilizer or a reactive terpolymer enabling connection of functional groups between the layers can also be added to the lead insulation and/or the plastic housing. The plastic materials of the lead insulation and the sensor housing are crosslinked in a separate crosslinking process under the effect of high-energy electron radiation.

16 Claims, 1 Drawing Sheet

STRING-SHAPED PRODUCT WITH CONNECTING AND/OR FIXING MEANS

TECHNICAL BACKGROUND

The invention concerns string-shaped or tape-shaped extruded linear products that incorporate at their ends thermoplastic end pieces or fixing means, whereby the thermoplastic end pieces or fixing means are radiation crosslinked together with the linear product during production.

The invention further concerns a method that is especially suited for the production of such a product.

Electric cables with welded or moulded connecting means are an example of such string-shaped products.

Electric cables according to this invention are for example equipped with a sensor means for measuring the rotation speed of a motor, gears, or a wheel at one end and incorporate an insulation, which is resistant against liquid, steam, or gaseous media depending on the use, and which may possibly include high resistance against mechanical wear.

PRIOR ART

Sensor cables of this type are for example used within the automotive industry, as well as the rail, aircraft and spacecraft industries. The sensor cables must satisfy special requirements especially for these applications and incorporate lead insulation with special characteristics. Amongst others the latter must therefore be oil resistant and resistant against various chemicals,
flame resistant and environmentally friendly,
temperature and friction resistant as well as
mechanically robust
resistant against ageing and reliable
flexible and environmentally resistant.

The interface via which the sensor means is connected to the cable must also satisfy these requirements at least in part.

For the production of insulated electric cables which produce a minimum of smoke in case of fire as well as no and/or only very small quantities of toxic gas, a halogen-free insulation material is used today, such as for example polyethylene, ethylene copolymers, and other polymers that can be irradiated.

The flame resistance of a halogen-free insulation material is—as is already known—achieved with an addition of aluminium trihydrate (ATH) and/or magnesium hydroxide. Electric cables with halogen-free insulation that incorporate such hydrates are known to suffer from the disadvantage of a reduced resistance against liquid media such as for example petrol, mineral oils, and organic solvents. In order to overcome this disadvantage the electric cables are equipped with a two-layer lead insulation, which in turn consists of a halogen-free inner insulation layer made from a flame resistant polymer, for example polyolefin-copolymer, and an outer protective layer made from a polyamide, a thermoplastic, halogen-free polyester elastomer, or a halogen-free, aromatic polyether. During the production of such electric cables polar polymers with oil-repellent characteristics are therefore selected for the chemically resistant outer layer. For the inner layer, however, plastics with good absorption characteristics for flame protection materials are available.

For the production of sensor cables, the electric cable and the sensor, which in turn consist of an electronic component containing a housing constructed from metal or plastic, are currently produced at separate industrial facilities and subsequently assembled at one of the two facilities or at a separate third facility to form the sensor cables. The cable sections intended for the production of the sensor cables are unwound from cable rolls, cut, and connected with the sensor during a separate working step, whereby the cable is first electrically conductively connected with the electronic component of the sensor, whereafter the sensor housing made of metal or plastic is affixed to the electronic component and welded or moulded to the cable sleeve.

A substantial disadvantage of this known process for the production of sensor cables consists of the fact that the two main components of the known sensor cable incorporate some physical characteristics that prevent an optimal connection of the lead insulation with the sensor housing. The plastic composition of the lead insulation with the material of the sensor housing is therefore not optimally compatible, even when the sensor housing also consists of plastic. This results in the fact that the preferably radiation crosslinked insulation layer of the electric cable adheres very poorly to the sensor housing, so that the oil and temperature resistance, as well as the mechanical robustness, and especially the extraction force, is limited far more than desired. Known products also often show weaknesses when large temperature fluctuations occur and struggle to maintain their characteristics over extended time periods.

BRIEF SUMMARY OF THE INVENTION

It is the purpose of this invention to provide a novel electric cable with connecting means, especially a sensor cable of the type mentioned above, that does not incorporate the above mentioned disadvantages, and that is especially relatively easy to produce thanks to a logistically adapted method. The method shall be especially suitable also for the production of any other string-shaped products such as for example plastic pipes, plastic hoses, foils and foil laminate.

This task is solved in accordance with the invention by a string-shaped product, for example an electric cable, with the characteristics described below.

Preferred embodiments of the electric cable of this invention and the method of this invention are described below.

DETAILED DESCRIPTION OF THE PREFERRED EMBODIMENTS

Figure 1:
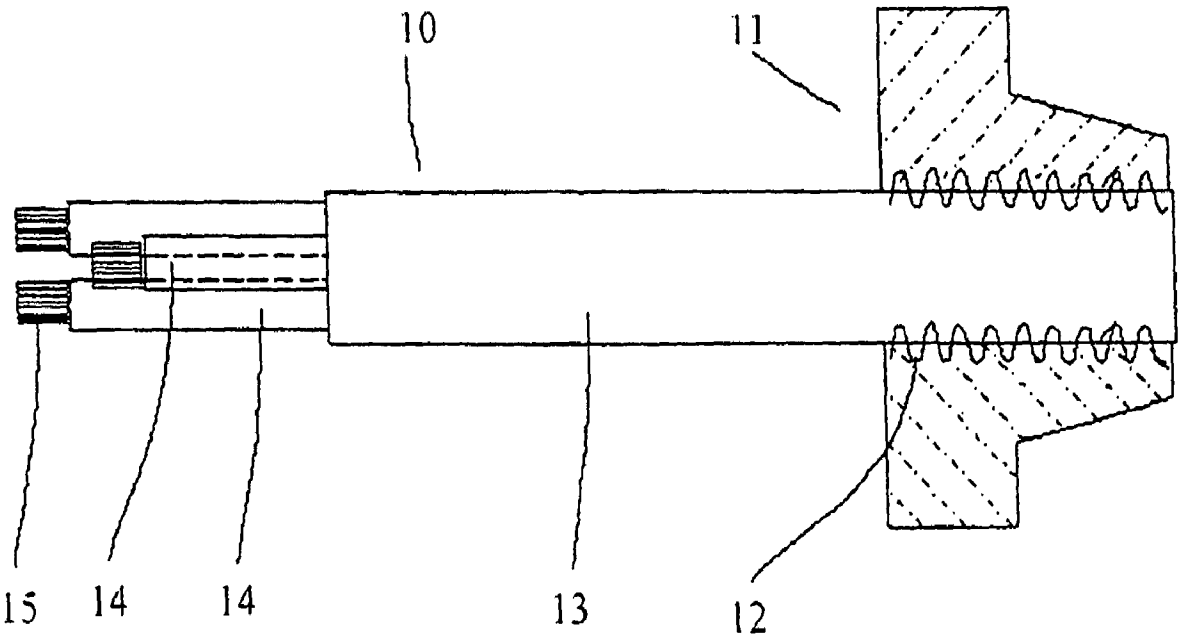
FIG. 1 illustrates one embodiment of the invention.

In one preferred embodiment of the invention the cable takes the form of a sensor cable, i.e. sensor line, and the lead insulation consists also of a flame resistant and halogen-free, radiation crosslinkable polymer layer, which in turn contains a polyamide, a polyolefin, or a polyolefin blend. Depending on the type and application of the string-shaped product, all radiation crosslinkable plastics are suitable for the realisation of the invention, whereby halogen-containing plastics are especially suitable for higher temperatures, if this is an advantage, for example fluor-containing polymers.

In comparison, the sensor of the known type consists of an electric component and a housing containing the electric component, the housing being made from plastic. According to the present invention, the housing consists of a plastic or plastic mixture that is compatible with the lead insulation and is radiation crosslinkable, containing for example at least one polyamide and/or a polyolefin, such as polyethylene. The polymers of the lead insulation and the polymers of the sensor housing are preferably selected in such a way that they can be moulded together in their assembled, but non-crosslinked state.

The sensor cable can be produced in this case as follows:

Following the extrusion of the preferably non-crosslinked or only partially crosslinked raw lead, the lead is cut into individual cable sections which are then electrically conductively connected with a sensor at their ends in the known way.

Subsequently the plastic of the lead insulation and that of the sensor housing, connected with one another in their pre-produced form of the cable at least in part, for example moulded together, are crosslinked during a separate crosslinking process under the influence of energy-rich electron radiation (electron beam radiation). This will result in a connection of the polymers of the lead insulation with those of the sensor housing to form one polymer network, so that a predominantly mechanically resistant cable construction is created in this way.

In a further embodiment of the sensor cable described above, as shown in FIG. 1, the lead insulation of the cable 10 consists of a co-extrudant, for example consisting of a flame resistant, halogen-free inner polymer layer 14 and a chemically resistant, oil resistant, outer polymer layer 13, which is especially adherent to, (i.e. connected with) the same and compatible with the same, and which possibly also contains additional flame protection material. In this embodiment the inner layer 14 incorporates at least one polyolefin or polyolefin blend, and the outer layer 13 incorporates a polyester elastomer and/or a polyamide and/or a polyethylene, such as for example a high density polyethylene (HDPE). In addition the outer layer 13 is also formed in such a way and adapted to the plastic composition of the sensor housing 11, that the outer layer 13 can be moulded to the sensor housing 11 and radiation crosslinked in the way described above. The outer layer 13 therefore normally consists of an extrudable plastic that can be crosslinked.

For the production of electric cables 10, the raw cable is therefore cut into individual sections in this case also, which are then connected to a sensor at their ends, for example by molding. Following this at least the polymers of the outer layer 13 of the lead insulation and the polymers of the sensor housing 11 are treated under the influence of energy-rich electron radiation (electron beam radiation) in such a way that the outer layer 13 and the sensor housing 11 crosslink to form one single polymer network 12.

Yet another embodiment of an electric cable 10 according to this invention consists of several electric leads interwoven with one another.

Such a cable is equipped with a one or two-layer sleeve and can be produced as follows.

On a copper braid, itself consisting of a multitude of individual wires 15 with a total cross-section of 0.13 $mm^2$ to 16 $mm^2$ a normally radiation crosslinkable insulation layer is first applied. Two or more such insulated leads are then, usually following an interweaving process, coated with an outer sleeve 13 layer through co-extrusion, for which two raw materials preferably belonging to the previously mentioned connection classes for the inner, and outer layer 14, 13 of a lead insulation and intended for the formation of the inner and outer sleeve layers 14, 13 are supplied.

The inner material layer 14 is preferably produced with a thickness of 0.1 to 2 mm, more preferably 0.2 to 1.5 mm, whilst the layer thickness of the outer layer 13 can be relatively thin and generally consists of approximately 0.05 to 0.5 mm. If the outer layer 13 does not contain a flame protection material, the flame resistant characteristics of the entire lead insulation are provided by the inner layer 14. Accordingly it is important that the volume ratio, (i.e. the layer thickness ratio of the two layers) is matched.

Due to their polymer composition, both layers of the cable sleeve incorporate robust mechanical characteristics. In particular, the inner layer 14 thus incorporates a high tensile strength and high expansion capabilities, and the outer layer 13 incorporates a high friction resistance.

Whilst the outer layer 13 incorporates at least one polyester elastomer and/or a mechanically robust polymer and is selected primarily so that its plastic composition can be moulded to and crosslinked with the housing 11 of the connecting means, for example the sensor, the inner layer 14 can be formed differently depending on the application, for example with good absorption characteristics for flame protection material.

For the production of electric cables, the raw cable is cut into individual cable sections in this case also, which are then connected to a sensor at their ends, whereby this results especially in the connection, and possibly the moulding of the sensor housing 11 and outer sleeve layer 13. Following this, at least the polymers of the outer sleeve layer 13 and the polymers of the sensor housing 11 are treated under the influence of energy-rich electron radiation (electron beam radiation) in such a way that the outer sleeve layer 13 and the sensor housing 11 crosslink to form a single polymer network 12.

The overall characteristics profile of the double-layer lead insulation or the possibly present double-layer cable sleeve is provided by a task distribution between the two layers of the insulation.

Suitable polyolefins for the formation of the single layer lead, the single layer sleeve, or the outer lead, (i.e. sleeve layer) according to the invention are the following polymer groups:

- polyamides (PA)
- polybutyleneterphthalate (PBTP)
- polyethyleneterephtalate (PETP)
- polyethylene copolymers, such as for example ethylene-vinyl-acetate (EVA), ethylene-methylacrylate (EMA), ethylene-butylacrylate (EBA)
- EEA; EPDM; PE-C; PP;
- polyethylene homopolymers;
- maleic acid anhydride (MAH)-terpolymers;
- glycidylmethacrylate (GMA)-terpolymers; polyvinylchloride; styrolpolymers; ABS; BS; PS halogenated polymers; CSM; ETFE; PEP; FPM; PE-C; PVC; PVDF; PVF;
- elastomers and thermoplastic elastomers.

According to the invention the polymers of the inner lead and outer lead layer, i.e. the inner sleeve 14 and the outer sleeve layer 13 are selected in such a way that the inner sleeve 14 and the outer sleeve 13 adhere to one another, (i.e. are connected with one another) in their applied, co-extruded condition, so that the mechanical friction resistance of the lead insulation is increased. In order to further increase adhesion between the two layers, the at least one polymer of the inner layer 14 and/or the at least one polymer of the outer layer 13 can be equipped with an additional compatibilizer (for example a block polymer) or a reactive terpolymer, to enable a connection of functional groups between the layers.

Main characteristics of the possibly present outer lead or sleeve layers (as opposed to the total layer when the lead insulation or sleeve consists of one layer) for the connecting of the outer layer 13 with the sensor housing 11 according to the invention are the mouldability and crosslinkability of the outer layer 13 with the plastic of the sensor housing 11, i.e. the material composition of the relevant layers is determined by the sensor housing 11.

The choice of material for use with this invention is therefore according to the following sequence:

1. For the sensor housing 11 a heat-stable, crosslinkable, and possibly mouldable plastic should be chosen.
2. The cable enclosure should be chosen in such a way that the outer layer 13 can be thermoplastically moulded to and crosslinked with the relevant plastic of the sensor housing 11.

As already mentioned above at least the outer layer 13 of the lead insulation, (i.e. the cable sleeve) is radiation crosslinked with the sensor housing 11 in the end product of this invention. If one also wants to crosslink the relevant inner layer 14 in this particular embodiment the outer layer 13 raw material must possibly be additionally equipped with low molecular crosslinking enhancers.

The sensor cable of this invention has the following physical characteristics:

It incorporates a high mechanical firmness, especially within the area of the cut between cable and sensor means, which is due amongst others to the moulding together and crosslinking of lead insulation, i.e. the sleeve and sensor housing. The sensor cable is tight and resistant to ageing across a wide temperature range without additional auxiliary elements.

Flame resistance tests are passed successfully by the double-layer lead insulation, i.e. sleeve insulation.

The sensor cable of this invention with its double-layer lead insulation is not only oil resistant. It is also resistant against other liquids, chemicals, and steam, such as for example antifreeze, battery fluid, windscreen washer fluid, brake fluid, detergents, motor and gearbox as well as hydraulic fluids and petrol.

It can be used without problems especially within the automotive industry, and more specifically in connection with sensors for the measuring of rotation speed, torque, pressure, oxygen content, temperature, oil level, air quality, etc.

Finally it should be said that the above mentioned embodiments represent only a selection of several possible embodiments of the invention, and that the invention can be varied and amended in many different ways. It is therefore possible to crosslink the ends of entire cable harnesses as a single component set during one working step instead of individual sensor cables. Such cable harnesses are often used within the automotive industry and consist for example of several interconnected cable sections.

It is further possible in line with the method of this invention to produce plastic pipes and hoses with welded coupling sections crosslinked with the pipe, i.e. the hose as well as foils and laminates with welded and crosslinked folds and edge areas. In this case also the string-shaped products produced according to the invention incorporate improved characteristics with regard to temperature resistance, friction resistance, sealing, and tear resistance. Finally the method of this invention can also be used with suitable plastic compositions to reinforce, i.e. freeze the shape and/or structure of a component, for example the shape of a coiled cable, which in turn consists at least in part of radiation crosslinkable components, during a final process step by crosslinking. This shape will then be maintained even at high operating temperatures.

The invention claimed is:

1. An electrical cable comprising:

an electrical conductor;

an exterior insulation layer surrounding said electrical conductor; and a connector having a plastic housing welded together with said exterior insulation layer and crosslinked together with said exterior insulation layer by energy rich electron beam radiation so as to form a single polymer network.

2. The electrical cable of claim 1, wherein said exterior insulation layer includes a halogen-free, crosslinkable polymer layer which includes a polyamide, a polyolefin or a polyolefin blend.

3. The electrical cable of claim 1, wherein said exterior insulation layer includes a flame resistant, halogen-free, crosslinkable polymer layer which includes a polyamide, a polyolefin or a polyolefin blend.

4. The electrical cable of claim 1, wherein said plastic housing includes a plastic that is compatible and crosslinkable with said exterior insulation layer, and includes at least a polyamide, a polyolefin or a polyethylene.

5. The electrical cable of claim 1, further comprising a plurality of electrical conductors, including said electrical conductor, each of said electrical conductors being surrounded by a respective interior insulation layer, said plurality of electrical conductors and said interior insulation layers being surrounded by said exterior insulation layer.

6. The electrical cable of claim 5, wherein each of said interior insulation layers includes a flame resistant, halogen-free polymer layer including at least one polyolefin or polyolefin blend, and said exterior insulation layer includes a chemical resistant, oil resistant polymer layer including at least one polyester elastomer, a polyamide or a polyethylene.

7. The electrical cable of claim 5, wherein each of said interior insulation layers includes a flame resistant, halogen-free polymer layer including at least one polyolefin or polyolefin blend, and said exterior insulation layer includes a flame resistant, chemical resistant, oil resistant polymer layer including at least one polyester elastomer, a polyamide or a polyethylene.

8. The electrical cable of claim 5, wherein each of said interior insulation layers is crosslinked together with said exterior insulation layer.

9. A method for producing an electrical cable, the method comprising:

surrounding an electrical conductor with an exterior insulation layer;

welding the exterior insulation layer together with a plastic housing of a connector; and crosslinking the exterior insulation layer together with the plastic housing by energy rich electron beam radiation so as to form a single polymer network.

10. The method of claim 9, wherein the exterior insulation layer includes a halogen-free, crosslinkable polymer layer which includes a polyamide, a polyolefin or a polyolefin blend.

11. The method of claim 9, wherein the exterior insulation layer includes a flame resistant, halogen-free, crosslinkable polymer layer which includes a polyamide, a polyolefin or a polyolefin blend.

12. The method of claim 9, wherein the plastic housing includes a plastic that is compatible and crosslinkable with the exterior insulation layer, and includes at least a polyamide, a polyolefin or a polyethylene.

13. A method for producing an electrical cable, the method comprising:

surrounding each electrical conductor in a plurality of electrical conductors with a respective interior insulation layer;

surrounding the plurality of electrical conductors and the interior insulation layers with an exterior insulation layer;

welding the exterior insulation layer together with a plastic housing of a connector; and crosslinking the exterior insulation layer together with the plastic housing by energy rich electron beam radiation so as to form a single polymer network.

14. The method of claim 13, wherein each of the interior insulation layers includes a flame resistant, halogen-free polymer layer including at least one polyolefin or polyolefin blend, and the exterior insulation layer includes a chemical resistant, oil resistant polymer layer including at least one polyester elastomer, a polyamide or a polyethylene.

15. The method of claim 13, wherein each of the interior insulation layers includes a flame resistant, halogen-free polymer layer including at least one polyolefin or polyolefin blend, and the exterior insulation layer includes a flame resistant, chemical resistant, oil resistant polymer layer including at least one polyester elastomer, a polyamide or a polyethylene.

16. The method of claim 13, further comprising:

crosslinking each of the interior insulation layers together with the exterior insulation layer.

* * * * *